US005458338A

United States Patent [19]

Beardsley

[11] Patent Number: 5,458,338

[45] Date of Patent: Oct. 17, 1995

[54] GAME FOR TEACHING GRAMMAR

[76] Inventor: Richard Beardsley, C/O 402 Kings Way, Kalispell, Mont. 59901

[21] Appl. No.: 324,259

[22] Filed: Oct. 17, 1994

[51] Int. Cl.[6] ..... A63F 3/06

[52] U.S. Cl. ..... 273/269; 273/272

[58] Field of Search ..... 273/236, 242, 273/269, 272

[56] References Cited

U.S. PATENT DOCUMENTS

| | | | |
|---|---|---|---|
| 3,197,891 | 8/1965 | Pierce | 273/269 |
| 3,464,124 | 9/1969 | Lynd | 273/269 X |
| 4,021,937 | 5/1977 | Kravitz | 273/269 |
| 4,606,546 | 8/1986 | Rita | 273/269 |
| 4,953,869 | 9/1990 | Muhammad | 273/269 X |

FOREIGN PATENT DOCUMENTS

| | | | |
|---|---|---|---|
| 491948 | 4/1953 | Canada | 273/269 |
| 1548604 | 12/1968 | France | 273/269 |

OTHER PUBLICATIONS

CLEO learning aids, "Science Bingo Series", p. 187, Mar. 1976.

*Primary Examiner*—William E. Stoll

[57] ABSTRACT

A game for teaching grammar having a key card formed with a plurality of rows and columns, including columns with a heading across the top of the columns with letters to indicate a type for such column. The rows are marked with numbers. A different word or phrase is in each of the spaces in the rows and columns indicative of a part of speech and indicative of features of the English language with a plurality of calling cards, each includes a letter at the top indicative of one of the indicia letters across the top of the key card. Each calling card has a plurality of samples utilizing a particular feature of language and a question with regard to such samples and, in parentheses, the answer to the question. Also included is a plurality of individual playing cards. Each playing card is formed with rows and columns. The columns have a plurality of columns and a plurality of rows to form spaces with words indicative of features of language corresponding to the answers to the questions read by the reader of a calling card. Also included is a plurality of tiles, each tile with a letter and a number indicative of a row and a column to be selected by a reader for reading a corresponding calling card to the players. Lastly included are a plurality of markers.

5 Claims, 4 Drawing Sheets

| L | I | N | G | O |
|---|---|---|---|---|
| CLAUSE | COLLECTIVE NOUN | INDEFINITE PRONOUN | PERIOD | INDIRECT OBJECT |
| ADVERB | DIRECT OBJECT | SIMPLE SENT. | TRANSITIVE VERB | COLON |
| COMMON NOUN | RELATIVE PRONOUN | FREE 2 | PLURAL NOUN | APOS-TROPHE |
| ADJECTIVE | PHRASE | SINGULAR NOUN | COMMA | SEMICOLON |
| SUBJECT | PERSONAL PRONOUN | PAST TENSE | VERB | PAST PAPTICIPLE |

38 46 44 40 40 46 44 42 42 42

FIG. 4

| L | I | N | G | O |
|---|---|---|---|---|
| SUBJECT | RELATIVE PRONOUN | SINGULAR NOUN | COMMA | APOS-TROPHE |
| PROPER | PREPOS-ITION | SIMPLE SENT | DIRECT OBJECT | COLON |
| POSSESSIVE PRONOUN | PHRASE | FREE 35 | FUTURE NOUN | DASH |
| NOUN OF DIRECT ADDRESS | PERSONAL PRONOUN | PAST TENSE | PERIOD | DEMON STRATIVE PRONOUN |
| VERB | INTERJECT. | INDEFINITE PRONOUN | PLURAL NOUN | INDIRECT OBJECT |

38 40 40 40 46 46 44 44 42 42

FIG. 5

GAME FOR TEACHING GRAMMAR

BACKGROUND OF THE INVENTION

1. Field of the Invention

The present invention relates to a game for teaching grammar and more particularly pertains to teaching the elements of grammar through the use of a game played by a plurality of people.

2. Description of the Prior Art

The use of games of skill, chance and learning of a wide variety of designs and configurations is known in the prior art. More specifically, games of skill, chance and learning of a wide variety of designs and configurations heretofore devised and utilized for the purpose of entertaining participants in a game through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 3,542,368 to Ashley discloses a combination jigsaw puzzle and bingo game apparatus.

U.S. Pat. No. 3,618,951 to Parrick discloses an apparatus for playing a bingolike game.

U.S. Pat. No. 4,165,878 to Frain discloses a bingo game and process of playing same.

U.S. Pat. No. 4,711,454 to Small discloses a bingo game involving promotional coupons.

Lastly, U.S. Pat. No. 4,883,636 to Fantle discloses a baseball bingo game.

In this respect, the game for teaching grammar according to the present invention substantially departs from the conventional concepts and designs of the prior art, and in so doing provides an apparatus primarily developed for the purpose of teaching the elements of grammar through the use of a game played by a plurality of people.

Therefore, it can be appreciated that there exists a continuing need for a new and improved game for teaching grammar which can be used for teaching the elements of grammar through the use of a game played by a plurality of people. In this regard, the present invention substantially fulfills this need.

SUMMARY OF THE INVENTION

In view of the foregoing disadvantages inherent in the known types of games of skill, chance and learning of a wide variety of designs and configurations now present in the prior art, the present invention provides an improved game for teaching grammar. As such, the general purpose of the present invention, which will be described subsequently in greater detail, is to provide a new and improved game for teaching grammar apparatus and method which has all the advantages of the prior art and none of the disadvantages.

To attain this, the present invention essentially comprises a new and improved game for teaching grammar comprising, in combination, a key card formed with a plurality of rows and columns, including five columns with a heading across the top of the columns with the letters L, I, N, G and O in the heading of the columns to indicate a type for such column. The rows are marked with numbers from 1 through 50 in each column for a total of 50 spaces. A different word or phrase is in each of the spaces in the rows and columns indicative of a part of speech, or indicative of features of the English language used in the study of the English language. Fifty calling cards are included. Each calling card has a letter at the top indicative of one of the indicia letters across the top of the key card, Each calling card has a plurality of samples utilizing a particular feature of the English language and a question with regard to such samples and, in parentheses, the answer to the question. The calling cards are adapted to be read to players in the game by a reader. A plurality of individual playing cards are included. Each playing card is formed with rows and columns, the columns having five columns headed by the indicia in the form of letters L, I, N, G and O and five rows to form 25 spaces with words indicative of features of the English language corresponding to the answers to the questions read by the reader of a calling card. A plurality of tiles are included. Each tile has a letter and a number indicative of a row and a column to be selected by a reader for reading a corresponding calling card to the players. A plurality of markers are positionable over a particular space on the players individual calling card in response to the reading of a question whereby when the reader selects tiles and reads questions from the corresponding calling card. The player may place a marker on a space of the assigned playing card until one player covers five spaces horizontally, vertically or diagonally and calls LINGO to thereby win the game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game for teaching grammar which has all the advantages of the prior art games of skill, chance and learning of a wide variety of designs and configurations and none of the disadvantages.

It is another object of the present invention to provide a new and improved game for teaching grammar which may be easily and efficiently manufactured and marketed.

It is a further object of the present invention to provide a new and improved game for teaching grammar which is of a durable and reliable construction.

An even further object of the present invention is to provide a new and improved game for teaching grammar which is susceptible of a low cost of manufacture with regard to both materials and labor, and which accordingly is then susceptible of low prices of sale to the consuming public, thereby making such game of skill, chance and learning of a wide variety of designs and configurations economically available to the buying public.

Still yet another object of the present invention is to provide a new and improved game for teaching grammar which provides in the apparatuses and methods of the prior art some of the advantages thereof, while simultaneously overcoming some of the disadvantages normally associated therewith.

Still another object of the present invention is to teach the elements of grammar through the use of a game played by a plurality of people.

Lastly, it is an object of the present invention to provide a game for teaching grammar having a key card formed with a plurality of rows and columns, including columns with a heading across the top of the columns with letters to indicate a type for such column. The rows are marked with numbers. A different word or phrase is in each of the spaces in the rows and columns indicative of a part of speech and indicative of features of the English language with a plurality of calling cards, each includes a letter at the top indicative of one of the indicia letters across the top of the key card. Each calling card has a plurality of samples utilizing a particular feature of language and a question with regard to such samples and, in parentheses, the answer to the question. The calling cards are adapted to be read to players in the game by a reader. Also included is a plurality of individual playing cards. Each playing card is formed with rows and columns. The columns have a plurality of columns and a plurality of rows to form spaces with words indicative of features of language corresponding to the answers to the questions read by the reader of a calling card. Also included is a plurality of tiles, each tile with a letter and a number indicative of a row and a column to be selected by a reader for reading a corresponding calling card to the players. Lastly included is a plurality of markers positionable over a particular space on the players individual calling card in response to the reading of a question.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view of one type of individual playing card adapted to be used with the cards of the prior Figures.

FIG. 5 is another typical individual playing card similar to that shown in FIG. 4.

Similar reference characters refer to similar parts throughout the several views of the drawings.

DESCRIPTION OF THE PREFERRED EMBODIMENT

Figure 1:
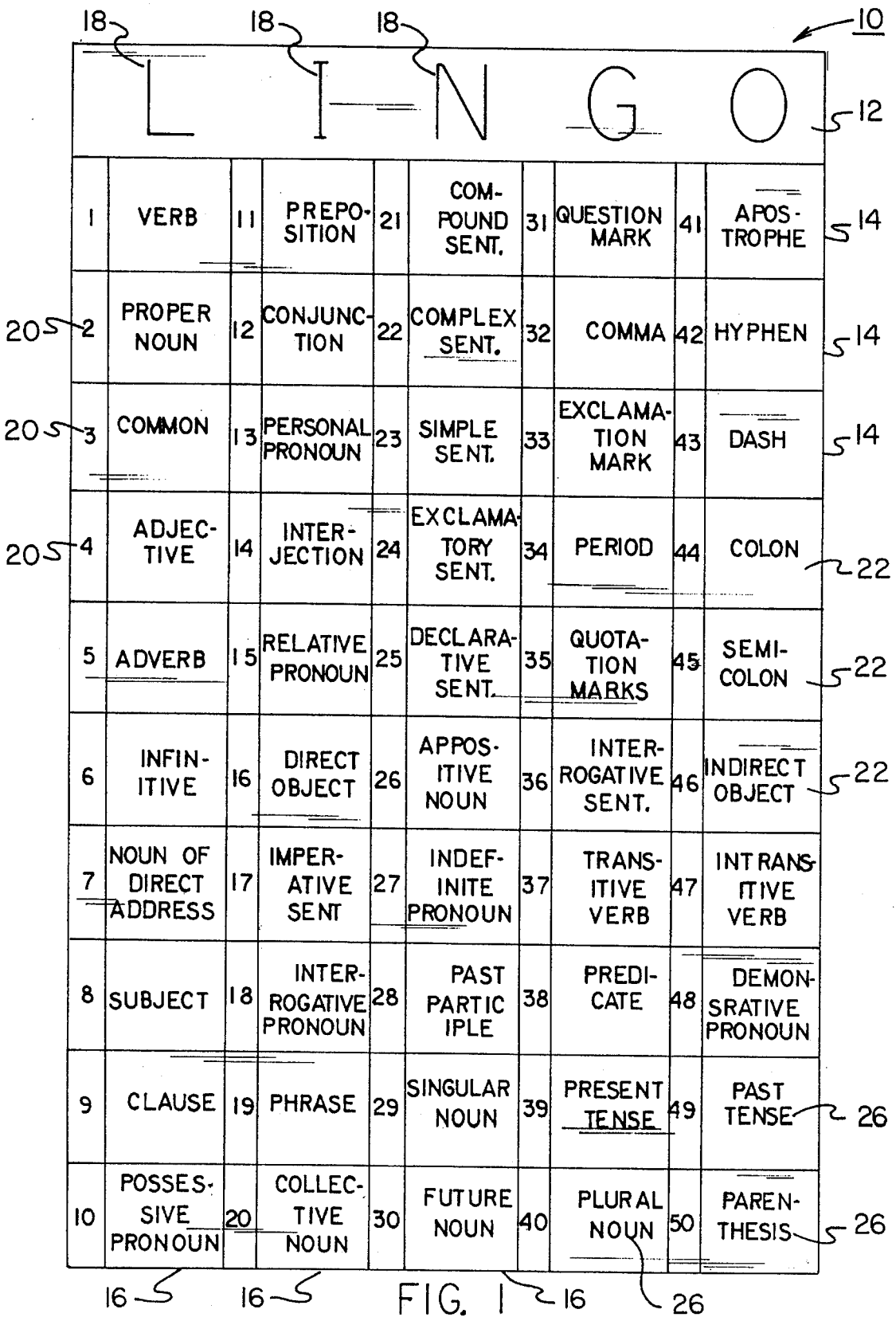
FIG. 1 is a front elevational view of a key card for use in association with the preferred embodiment of the game for teaching grammar constructed in accordance with the principles of the present invention.
Figure 2:
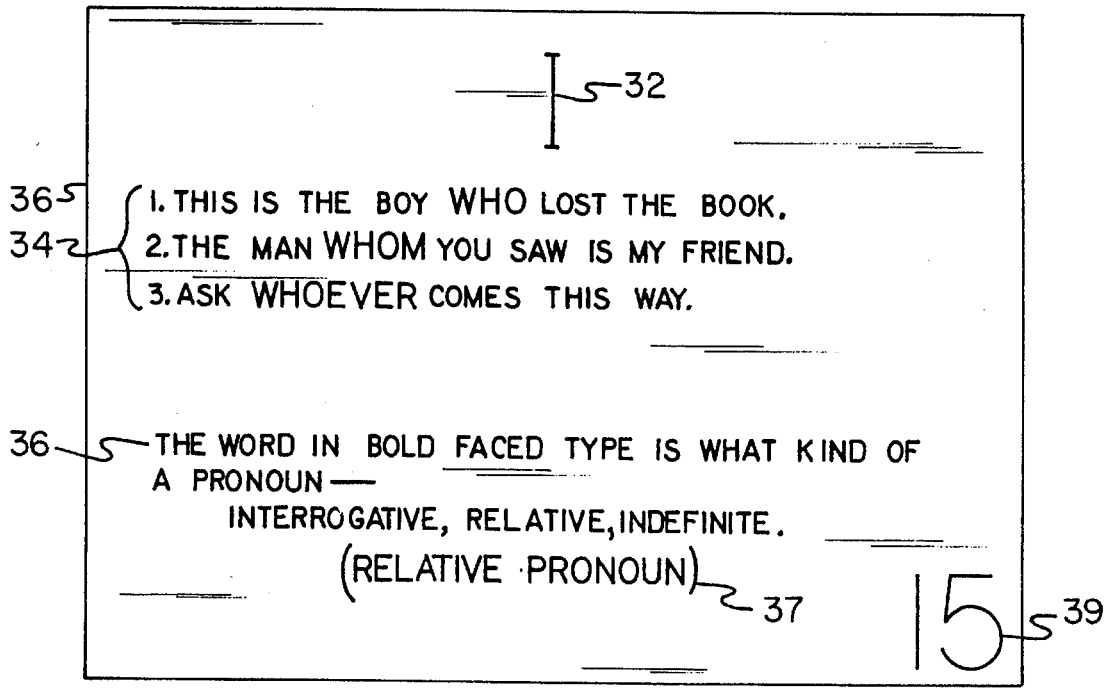
FIG. 2 is one example of a plurality of individual playing cards for use in association with the key card of FIG. 1.
Figure 3:
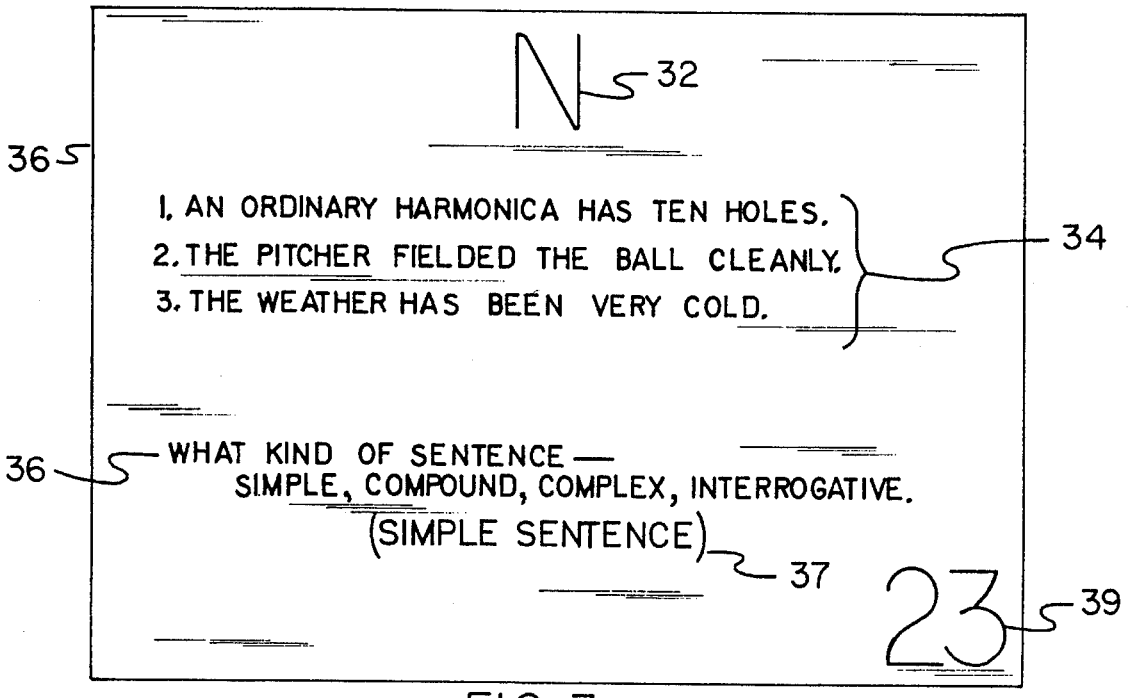
FIG. 3 is a plan view of another one of the individual playing cards similar to that of FIG. 2.
Figure 6:
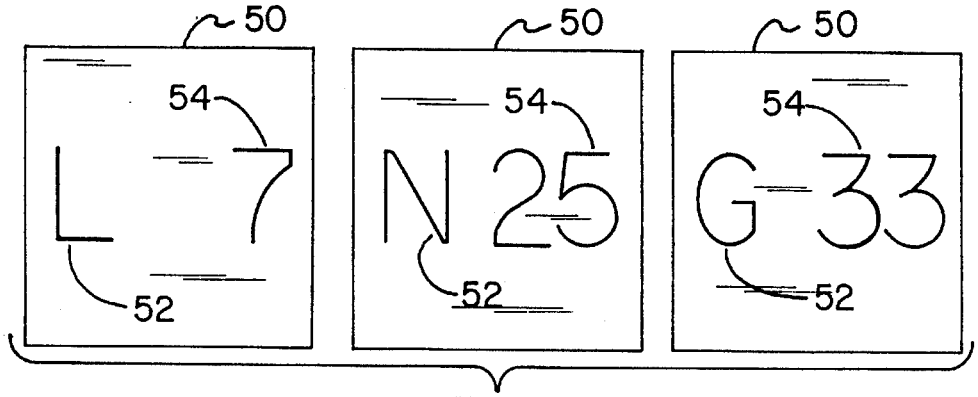
FIG. 6 is a typical example of selection markers adapted to be used in association with the items of FIGS. 1 through 5.
Figure 7:
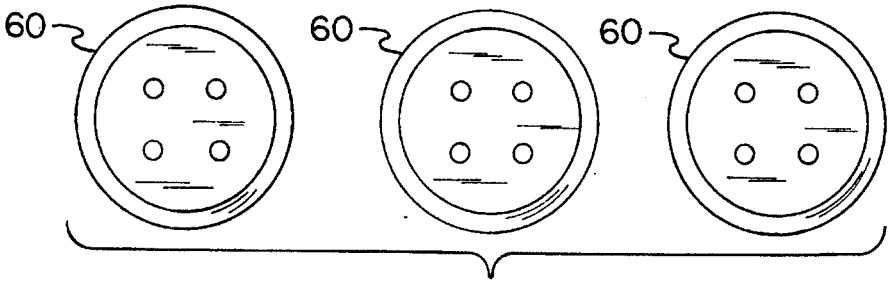
FIG. 7 is a front elevational view of three of a plurality of markers adapted to be used in association with the playing cards of the prior Figures.
Figure 8:
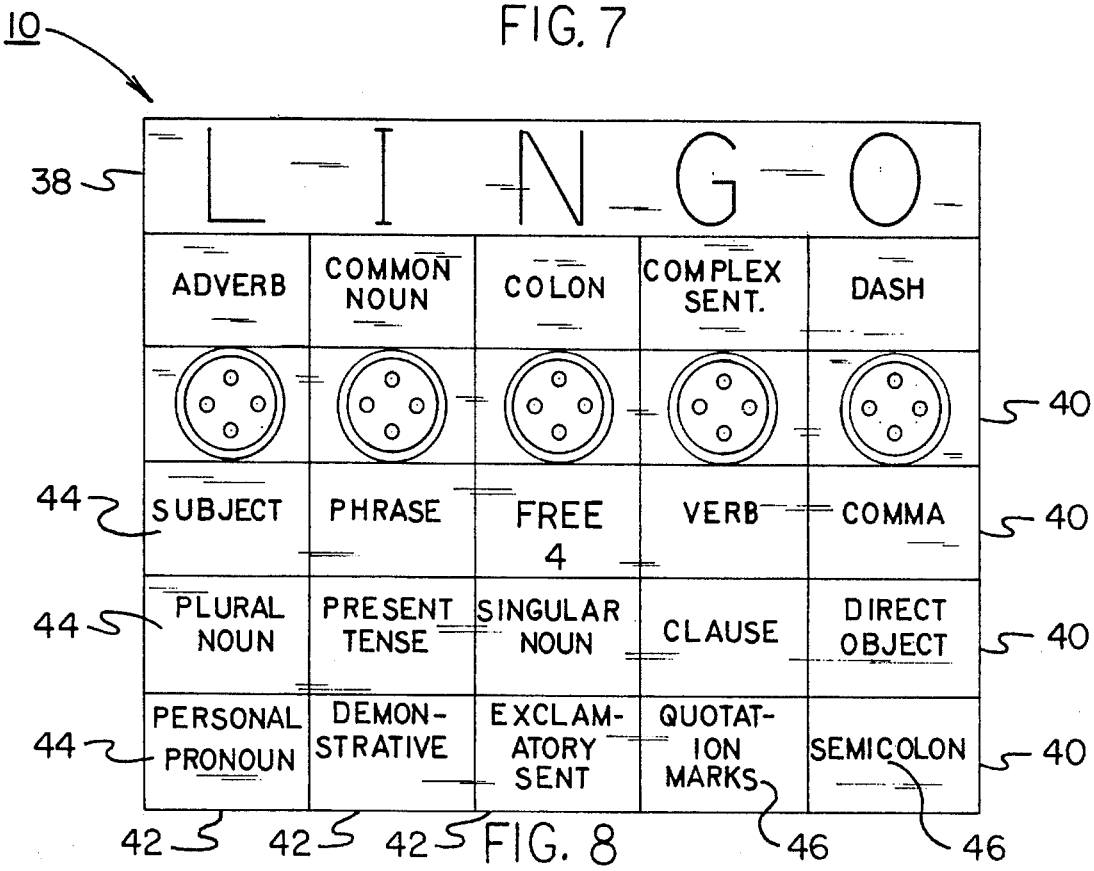
FIG. 8 is an illustration of one individual playing card with markers placed over a row in a playing card.

With reference now to the drawings, and in particular to FIG. 1 thereof, a new and improved game for teaching grammar embodying the principles and concepts of the present invention and generally designated by the reference numeral 10 will be described.

The present invention, the new and improved game for teaching grammar, is comprised of a plurality of components. Such components in their broadest context include a key card, a different word in the spaces of the card, a plurality of calling cards, a plurality of playing cards, a plurality of tiles, and a plurality of markers. Such components are individually configured and correlated with respect to each other so as to attain the desired objective.

One of the central elements of the system 10 of the present invention is a key card 12. Such key card is formed with a plurality of rows 14 and columns 16. These include five columns with a heading across the top of the columns with the letters 18 L, I, N, G and O in the heading of the columns to spell the word LINGO. This is to indicate a type for each column. The rows are marked with numbers 20. The numbers extend from 1 through 50 consecutively in each column. This provides for a total fifty spaces. A different word or phrase 26 is provided in each of the spaces in the rows and columns. The words are indicative of a part of speech, or indicative of features of the English language used in the study of the English language.

To be used by the reader are a plurality of calling cards 30. Each of the calling cards is provided with a letter 32 at the top indicative of one of the indicia letters across the top of the key card. Each calling card has a plurality of samples 34 utilizing a particular feature of the English language. Also included with each sample is a question 36 with regard to such samples. In addition, in parentheses, is the answer 37 to the question on the calling card. The calling cards are adapted to be read to players in the game by a reader.

Next provided for use by the individual players are individual playing cards 38. Each playing card is formed with rows 40 and columns 42. The columns have five columns headed by indicia in the form of letters L, I, N, G and O spelling the word LINGO. Each playing card also has five rows beneath the indicia LINGO. These thereby for twenty-five spaces 44. Within the spaces are words 46 indicative of features of the English language. Such features correspond to the answers to the questions read by the reader of a calling card.

Next provided are a plurality of tiles 50. Each tile is provided with a letter 52 and a number 54. These letters and numbers are indicative of a row and a column to be selected by a reader for reading a corresponding calling card to the player.

Lastly provided are a plurality of markers 60. Such markers are positionable over a particular space on the individual players calling card. They are so placed in proper position on the individual playing cards in response to the reading of a question by a reader. In this manner, when the reader selects tiles and reads questions from the corresponding calling card, the players may place a marker on the space of the assigned playing card. This continues until one player covers five spaces horizontally, vertically or diagonally. Upon such covering, the player calls LINGO to thereby win the game.

An educational game is thus provided that uses grammatical phrases relating to nouns, verbs, adverbs, etc., and that is played in a manner similar to the game of bingo.

The game consists of a key card, a number of Lingo cards, 50 cards with illustrations of grammatical phrases, and a container with 50 balls or objects marked with the numbers 1 through 50. The key card has 50 blocks on it, 10 in each of five columns, under the letter headings L, I, N, G and O. The blocks are numbered sequentially from 1 through 50 and contain grammatical names, forms of punctuation, etc. The lingo cards are very similar to Bingo cards. There are five columns of five blocks each under headings for the letters that make up the word Lingo. Each block contains a grammatical name with the exception of the center block, which is marked Free. The illustration cards have grammatical phrases on them corresponding to the 50 blocks on the key card.

The lingo cards are passed out to the individual players. The caller draws a number from the container and takes an illustration card with the corresponding number and reads from it, being sure to indicate under which letter it is situated. The players who have that grammatical name on their card cover it with a bean or button. This process continues until a player or players get a Lingo, horizontally, vertically or diagonally.

It is an excellent grammar teaching game for schools that can also be used at home. It is fun to play and can furnish many hours of entertainment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved game for teaching grammar comprising, in combination:

a key card formed with a plurality of rows and columns, including five columns with a heading across the top of the columns with the letters L, I, N, G and O in the heading of the columns to indicate a type for such column, and spaces being marked with numbers from 1 through 50 for a total of 50 spaces;

a different word or phrase in each of the spaces in the rows and columns indicative of a part of speech, or indicative of features of the English language used in the study of the English language;

fifty calling cards, each with a letter at the top indicative of one of the indicia letters across the top of the key card, each calling card having a plurality of samples utilizing a particular feature of the English language and a question with regard to such samples and, in parentheses, the answer to the question, the calling cards adapted to be read to players in the game by a reader;

a plurality of individual playing cards, each playing card being formed with rows and columns, the columns having five columns headed by the indicia in the form of letters L, I, N, G and O and five rows to form 25 spaces with words indicative of features of the English language corresponding to the answers to the questions read by the reader of a calling card;

a plurality of tiles, each tile with a letter and a number indicative of a row and a column to be selected by a reader for reading a corresponding calling card to the players; and a plurality of markers positionable over a particular space on the players individual calling card in response to the reading of a question whereby when the reader selects tiles and reads questions from the corresponding calling card, the player may place a marker on a space of the assigned playing card until one player covers five spaces horizontally, vertically or diagonally and calls LINGO to thereby win the game.

2. A game for teaching grammar comprising:

a key card formed with a plurality of rows and columns, including columns with a heading across the top of the columns with letters to indicate a type for such column, the rows being marked with numbers;

a different word or phrase in each of the spaces in the rows and columns indicative of a part of speech, indicative of features of the English language;

a plurality of calling cards, each with a letter at the top indicative of one of the indicia letters across the top of the key card, each calling card having a plurality of samples utilizing a particular feature of language and a question with regard to such samples and, in parentheses, the answer to the question, the calling cards adapted to be read to players in the game by a reader;

a plurality of individual playing cards, each playing card being formed with rows and columns, the columns having a plurality of columns and a plurality of rows to form spaces with words indicative of features of language corresponding to the answers to the questions read by the reader of a calling card;

a plurality of tiles, each tile with a letter and a number indicative of a row and a column to be selected by a reader for reading a corresponding calling card to the players; and a plurality of markers positionable over a particular space on the players individual calling card in response to the reading of a question whereby when the reader selects tiles and reads questions from the corresponding calling card, the player may place a marker on a space of the assigned playing card until one player covers a row of spaces horizontally, vertically or diagonally and calls to thereby win the game.

3. The apparatus as set forth in claim 2 wherein the language is English.

4. The apparatus as set forth in claim 2 wherein the indicia above the columns of the playing cards and the indicia of the calling cards is a five letter word.

5. The apparatus as set forth in claim 4 wherein the five letter word is LINGO.

* * * * *